US009093036B2

(12) United States Patent
Ben-Chorin

(10) Patent No.: US 9,093,036 B2
(45) Date of Patent: Jul. 28, 2015

(54) DETERMINING SIZE OF SUB PIXELS IN A MULTI PRIMARY DISPLAY FOR MAXIMIZING WHITE POINT LUMINANCE LEVEL

(75) Inventor: Moshe Ben-Chorin, Rehovot (IL)

(73) Assignee: SAMSUNG DISPLAY CO., LTD. (KR)

( * ) Notice: Subject to any disclaimer, the term of this patent is extended or adjusted under 35 U.S.C. 154(b) by 303 days.

(21) Appl. No.: 13/471,305

(22) Filed: May 14, 2012

(65) Prior Publication Data

US 2013/0300640 A1 Nov. 14, 2013

(51) Int. Cl.
*G09G 5/02* (2006.01)
*G09G 3/36* (2006.01)

(52) U.S. Cl.
CPC ..... *G09G 3/3607* (2013.01); *G09G 2300/0452* (2013.01); *G09G 2320/0666* (2013.01)

(58) Field of Classification Search
CPC ..... G02F 2201/52; G02F 1/133514; G02F 2001/134345; H01L 2924/0002; H01L 2924/00; H04N 1/2112; H04N 2101/00
See application file for complete search history.

(56) References Cited

U.S. PATENT DOCUMENTS

| | | | | |
|---|---|---|---|---|
| 2007/0200807 | A1* | 8/2007 | Lee et al. | 345/88 |
| 2009/0115803 | A1* | 5/2009 | Langendijk et al. | 345/690 |
| 2009/0128755 | A1* | 5/2009 | Roth et al. | 349/106 |
| 2013/0088522 | A1* | 4/2013 | Gettemy et al. | 345/690 |

* cited by examiner

*Primary Examiner* — Alexander Eisen
*Assistant Examiner* — Nan-Ying Yang
(74) *Attorney, Agent, or Firm* — Innovation Counsel LLP

(57) ABSTRACT

A method of determining area size of sub pixels in a multi primary display for maximizing white point luminance level is provided herein. The method includes the following stages: obtaining optical properties of a backlight module and of multi primary filters for a multi primary display; obtaining a white point chromaticity for the sub-pixel layout; obtaining, for each one of the primaries intensity ratio between the color primary and the white point; representing a luminance level of the multi primary display based on obtained data, at the required white point chromaticity, as a set of equations in terms of a relative area size of the sub-pixels of the multi primary display; solving the set of equations, to yield ratios of area sizes of the sub-pixels that result in a specified value of luminance at the white point chromaticity.

8 Claims, 4 Drawing Sheets

FIG. 3

200

| | RED | GREEN | BLUE | CYAN | YELLOW | SUM |
|---|---|---|---|---|---|---|
| REL.AREA | 0.235 | 0.149 | 0.329 | 0.113 | 0.175 | 1 |
| ROUNDED | 3 | 2 | 4 | 1 | 2 | 12 |
| #SUB-PIXELS | 3 | 2 | 4 | 1 | 2 | 12 |

FIG. 4

300

| | X | Y | Y/Yw | |
|---|---|---|---|---|
| RED | 0.6557 | 0.3292 | 10.9% | GAIN |
| GREEN | 0.2820 | 0.5979 | 28.9% | |
| BLUE | 0.1497 | 0.06810 | 11.2% | |
| CYAN | 0.1654 | 0.2658 | 7.5% | |
| YELLOW | 0.4244 | 0.5384 | 42.9% | |
| RAW | 0.2780 | 0.2862 | 101.4% | 1.21 |
| ADJ.WP | 0.275 | 0.285 | 100% | 1.28 |

DETERMINING SIZE OF SUB PIXELS IN A MULTI PRIMARY DISPLAY FOR MAXIMIZING WHITE POINT LUMINANCE LEVEL

BACKGROUND

1. Technical Field

The present invention relates to liquid crystal displays (LCDs) and more particularly, to LCD displays employing multi primary color matrixes.

2. Discussion of the Related Art

Designing LCD displays entails meeting a large number of constraints that are either imposed by the end product manufacturer or by the electronic or physical limitations of the components that constitute the display device.

During the design process of an LCD display, a selection of specific color primaries determines the color performance of the display. The color primaries are produced by filtering the white backlight through the color filters and the liquid crystal cells. The chromaticity of the primaries is influenced by the spectral transmission curves of the filters, the emission of the backlight and the transmission of the liquid crystal cell. Additionally, the size of each sub-pixel as determined by the black matrix affects the luminance of each of the primaries.

Several attempts to provide display devices with variable size (e.g., area) of sub pixels are known in the art. One attempt discloses a display with differently-sized sub-pixels for different primaries. In this attempt, the relative sizes of the primaries are changed to control the luminance of the white and the relative luminance of the primary (for example, red) with respect to the white. However, none of the current solutions provide an optimization method for optimal division of the area between the different primaries sub-pixel in order to reach a specified value of luminance, such as maximal luminance at the required white point.

BRIEF SUMMARY

One aspect of the present invention provides a computer-implemented method of determining area size of sub pixels in a multi primary display for maximizing white point luminance level. The method includes the following stages: obtaining data indicative of optical properties of a backlight module and of multi primary filters for a multi primary display including a sub-pixel layout, wherein each sub-pixel is associated with a primary color; obtaining a required white point chromaticity for the sub-pixel layout; obtaining, for each one of the primary colors, data indicative of an intensity ratio between the primary color and the required white point chromaticity for the multi primary display; representing a luminance level of the multi primary display in accordance with the obtained data, at the required white point chromaticity, as a set of expressions (equations and inequalities) in terms of relative sizes of the sub-pixels of the multi primary display; solving the set of expressions to yield ratios of sizes of the sub-pixels that result in a specified value of luminance at the white point chromaticity.

In another aspect, the invention is a computer-program product, encoded on a computer-readable medium operable to cause data processing apparatus to perform an operation including the above method.

In yet another aspect, the invention is a display device that includes a backlight unit and an array of filters, each filter constituting a sub-pixel in a multi primary color display. The primary colors in each sub-pixel constitute a variable size, and the size of each primary color is optimized based on (i) a required white point, (ii) an intensity ratio between the color primary and the required white point chromaticity; and (iii) optical and physical properties of the backlight unit and the filters, to yield a specified value of luminance at the required white point chromaticity.

These, additional, and/or other aspects and/or advantages of the embodiments of the present invention are set forth in the detailed description which follows; possibly inferable from the detailed description; and/or learnable by practice of the embodiments of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings:

FIG. 3 is a table illustrating an aspect of the invention according to some embodiments; and FIG. 4 is a table illustrating another aspect of the invention according to some embodiments.

Figure 1:
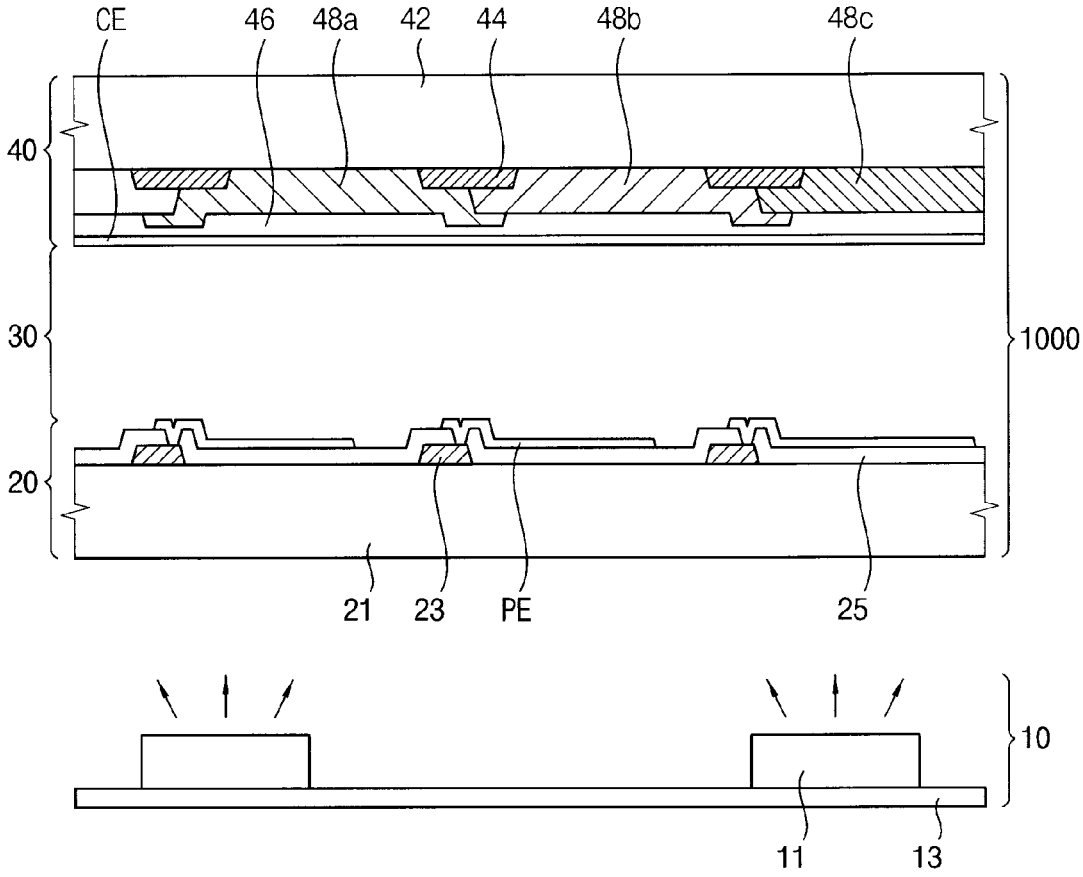
FIG. 1 is a cross-sectional view illustrating a display device according to some embodiments of the invention.

The drawings together with the following detailed description make apparent to those skilled in the art how the invention may be embodied in practice.

DETAILED DESCRIPTION

The present invention, in embodiments thereof, provides an optimization method for determining the size (e.g., surface area) of sub-pixels in a multi primary color display device. "Multi primary" color display device, as used herein, refers to display devices having sub-pixels of at least four different colors (one color may be white). In order to carry out the optimization, certain properties of the display were represented in relation to the size metrics of the sub-pixels and an analysis was carried out as detailed below.

For any color display, the absolute color coordinates may be represented with the following three equations:

$$X_i = \frac{A_i d_i}{A} \cdot AR_i \cdot \int \bar{x}(\lambda) \cdot BL(\lambda) \cdot LC(\lambda) \cdot F_i(\lambda) d\lambda = K_i X_i^o$$

$$Y_i = \frac{A_i d_i}{A} \cdot AR_i \cdot \int \bar{y}(\lambda) \cdot BL(\lambda) \cdot LC(\lambda) \cdot F_i(\lambda) d\lambda = K_i Y_i^o$$

$$Z_i = \frac{A_i d_i}{A} \cdot AR_i \cdot \int \bar{z}(\lambda) \cdot BL(\lambda) \cdot LC(\lambda) \cdot F_i(\lambda) d\lambda = K_i Z_i^o$$

In the above equations, $BL(\lambda)$ and $LC(\lambda)$ denote the backlight emission spectrum and the liquid crystal cell transmission spectrum respectively, $F_i(\lambda)$ denotes the transmission spectra of filter i=R,G,B,C,Y, and $x(\lambda)$, $y(\lambda)$ and $z(\lambda)$ are the color matching functions for the 2° 1931 CIE standard observer.

$A_i d_i/A$ is the fraction of the total area that sub-pixels of color i occupy ($A=\Sigma_i A_i d_i$) where $d_i$ is the number of sub-pixels of color i within the repeating unit containing all colors, $A_i$ is the area of sub-pixel of color i, and A is the total area of the repeating unit. $AR_i$ is the aperture ratio of sub-pixel of color i, which measures the ratio of transparent area of the sub-pixel to its physical area $A_i$. It is noted that the parameters $A_i$, $d_i$ are design parameters that will affect the ratio of the luminance levels of different primary colors, while $F_i(\lambda)$ determines both the chromaticity and to some extent the luminance of the primary. The $AR_i$ is also used for determining the ratio of luminance levels of the different primaries and the total luminance of the display. However, the value $AR_i$ is determined by the backplane technology (taking into account the area of the sub-pixels). $XYZ_i$ gives the geometrically corrected absolute color, $XYZ_i^o$ is the color without taking the geometrical factors into consideration, and the ratio between them denoted as $K_i$ lumps all these factors in a single number.

When the sub-pixels vary in size, Ki may be different for different primary colors. The removal of the constraint on the sub-pixel areas allows using the $K_i$'s as an optimization parameter. The optimization is performed to obtain maximum luminance at the required white point chromaticity and at the same time having the relative intensity of the primaries with respect to the white primary at high enough level. A formal representation of the optimization problem may be given in the following set of equations:

The luminanace of the white is provided as follows:

$$Y_w=\Sigma_{i=R,G,B,Y,C}(K_i \cdot Y_i^o) \tag{1}$$

under the following constraints:

$$O \le K_i \le 1 \ \forall_i = R, G, B, C, Y \tag{2}$$

$$\sum_{i=R,G,B,Y,C} K_i = 1 \tag{3}$$

$$\sum_{i=R,G,B,Y,C} K_i \cdot (x_w \sigma_i - X_i^o) = O \tag{4}$$

$$\sum_{i=R,G,B,Y,C} K_i \cdot (y_w \sigma_i - Y_i^o) = O \tag{5}$$

$$\frac{K_i Y_i^o}{\sum_{i=R,G,B,Y,C} K_i Y_i^o} \ge \beta_i \tag{6}$$

Equation (1) gives the luminance of the white (the combination of all primaries), which usually is used as a cost function; namely, the white luminance is the function that is maximized. Equation (2) limits the areas to be smaller than the total area (and larger than zero, other lower limit can be also set as determined by the technology). Equation (3) requires that the sum of all partial areas be equal to the total area. The constraints given in Equations (4) and (5) assure that the sum over the sub-pixels yields the required white point (in terms of its chromaticity coordinates). The constraints given in Equation (6) reflect the requirement on the relative intensity of the different primaries with respect to the white. The value in the numerator is the luminance of primary i, while that in the denominator is the luminance of the white. The values βj are set according to tests and simulations.

FIG. 1 is a cross-sectional view illustrating a display device according to some embodiments of the present invention. The display device includes a display panel 1000 and a backlight module 10. The backlight module 10 includes a light source 11 providing light to the display panel 1000, and a substrate 13, on which the light source 11 is mounted. The display panel 1000 includes an array substrate 20, an opposing substrate 40 and a liquid crystal layer 30 interposed between the array substrate 20 and the opposing substrate 40. The array substrate 20 includes a switching element 23, an insulation layer 25 covering the switching element 23, and a pixel electrode PE electrically connected to the switching element 23, which are formed on a first base substrate 21. The switching element 23 is turned on/off by a gate signal applied through a gate line, and the pixel electrode PE receives a data signal through a data line and the switching element 23. The opposing substrate 40 includes a second base substrate 42, a black matrix 44, color filters 48*a*, 48*b* and 48*c*, an overcoating layer 46 formed on the color filters 48*a*, 48*b* and 48*c*, and a common electrode CE formed on the overcoating layer 46 to face the array substrate 20. The color filters may define a size of sub-pixels in a plan view. The color filters represent primary colors, respectively. For example, the color filters include a red color filter 48*a*, a green color filter 48*b* and a blue color filter 48*c*. The color filters may further include different color filters such as, a cyan color filter, a yellow color filter or a white color filter. In another embodiment, the color filters and/or the common electrode may be formed at the array substrate.

Figure 2:
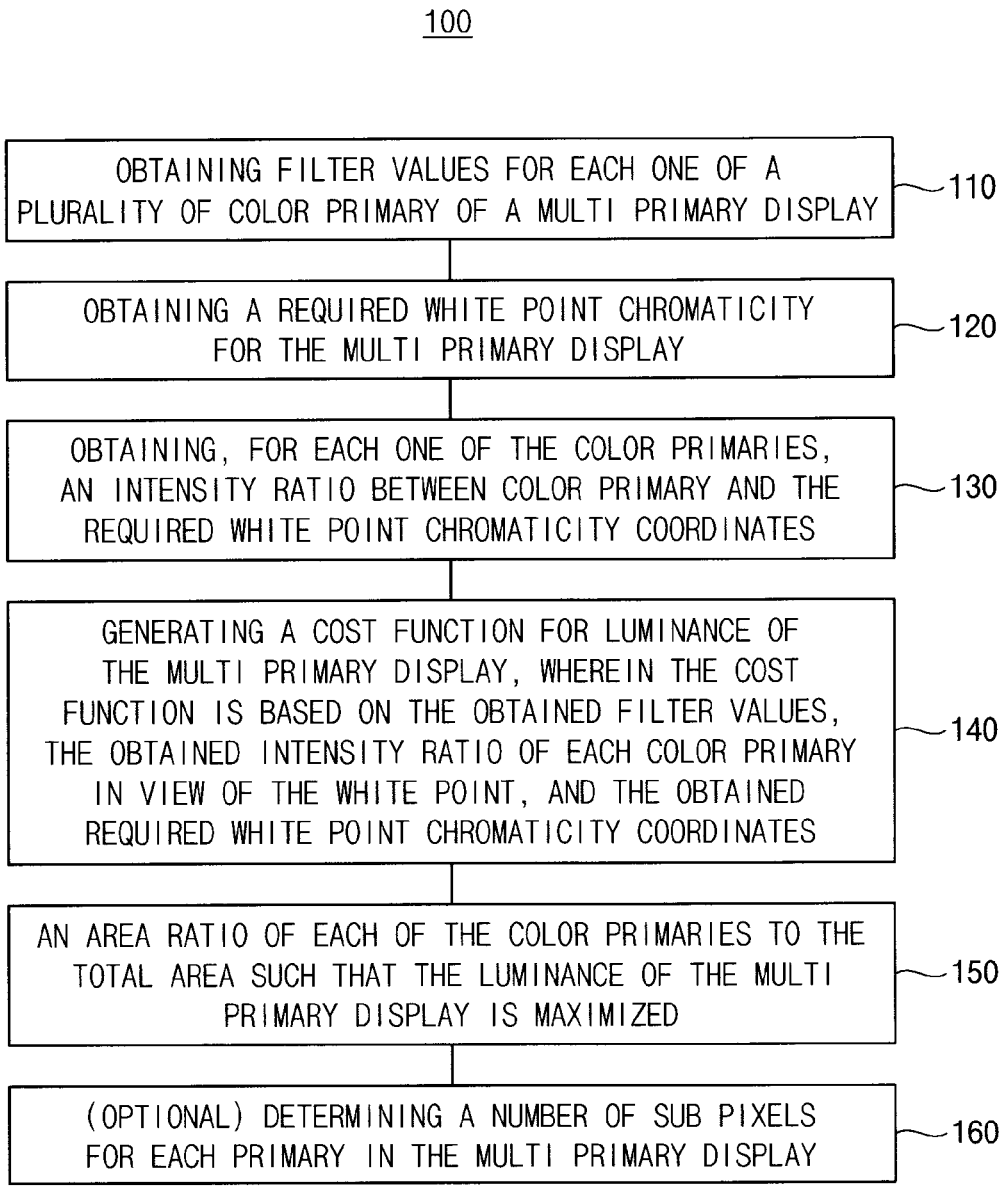
FIG. 2 is a high level flowchart illustrating a method according to some embodiments of the invention.

FIG. 2 is a high level flowchart illustrating a method 100 according to some embodiments of the present invention. Method 100 starts with obtaining filter values for each one of a plurality of color primary of a multi primary display 110. The method goes on to the stages of obtaining a required white point chromaticity for the multi primary display 120 and obtaining, for each one of the color primaries, an intensity ratio between a color primary and the the required white point chromaticity level 130.

The method then goes on to generating a cost (or objective) function. In optimization, the cost (or objective) function is usually the function in which one looks for a minimum (maximum) while the constraints limit the possible solutions. In the case we described above, the cost function is the white luminance level, which is maximized under the constraints given by Equations 2-6. The cost function may be based on the obtained filter values, the obtained intensity ratio of each color primary in view of the white point, and the obtained required white point chromaticity coordinates 140. It is understood that by changing the constraints and adding them to the cost functions, modifications of the cost function may be generated. For example, while it might be possible to state that the intensity of the red primary should not be higher than the certain level as prescribed by Equation (6), it would also be possible to take a weighted combination of the white luminance and the red relative intensity as a cost function that should be maximized.

Finally, the method goes on to a stage of determining, by using the cost function, an area ratio of each of the color primaries to the total area such that the luminance of the multi primary display (or other cost function chosen) is maximized 150. Optionally, for practical purposes, the method may include determining the number of sub-pixels of an identical size for each primary in the multi primary display. Thus, the optimization of the effective size is realized while still using identical size for the sub-pixels.

Consistent with some embodiments of the invention, the cost function of Equation (1) and the constraints of Equations (2)-(6) may be provided with further constraints such as actual and physical size of the sub-pixels (minimal and maximal size, proportion and the like). Additionally, different points of white may be tried in order to reach optimal results. Additionally, a plurality of sets of primary including their combinations may be tried so that all constraints and requirements are met. By using the aforementioned optimization tool, a wider selection of design may be reached allowing more degrees of freedom in the design of multi primary color device.

FIG. 3 is a table 200 illustrating a non limiting example. The table shows calculated area ratios reached based on Equations (1)-(6) mentioned above with given requirements. For practical reasons, the calculated areas are rounded and may be used in a several-sub-pixels—per-color configuration.

FIG. 4 is a table illustrating the chromaticity coordinates of the primaries and their relative intensity with respect to the white luminance. Also shown are the luminance gain of the multi-primary display with respect to an RGB display having the same R, G, and B primaries. This is in accordance with the non-limiting practical example of FIG. 3. It may well be noticed that the figures demonstrated in the table provide a significant increase of performance compared with existing equal size sub-pixels or non-optimized varying size sub-pixels known in the art.

Figure 5:
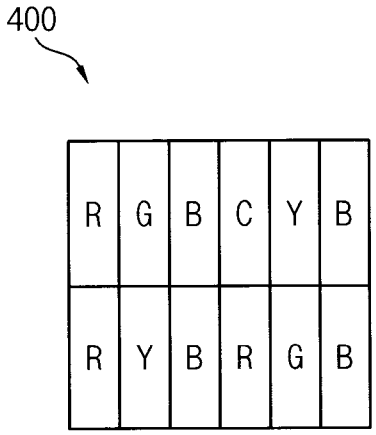
FIG. 5 is diagram showing a practical implementation that derives from an aspect of the invention in accordance with some embodiments.

FIG. 5 is a diagram showing an exemplary sub-pixel layout of a practical implementation of the present invention. In order to implement the present invention in display devices having sub-pixels of the same size, a layout in which several sub-pixels are used for each primary color, as in a sub-pixel layout 400, may be used in order to represent the area ratios calculated in the aforementioned manner. Thus, subject to rounding the ratios, a larger sub-pixel may be substituted by a plurality of smaller sub-pixels whereas a smaller size sub-pixel may be represented as a single sub-pixel. As may shown in configuration 400, it may be advantageous to gather sets of RGB sub-pixels together.

The invention and the functional operations described herein can be implemented in digital electronic circuitry, or in computer software, firmware, or hardware, including the structures disclosed in this specification and their structural equivalents, or in combinations of one or more of them. The invention can be implemented as one or more computer program products, i.e., one or more modules of computer program instructions encoded on a computer-readable medium for execution by, or to control the operation of, data processing apparatus.

The computer-readable medium can be a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including a programmable processor, a computer, or multiple processors or computers. The apparatus can include, in addition to hardware, code that creates an execution environment for the computer program in question, e.g. code that constitutes processor firmware, a protocol stack, a database management system, an operating system, or a combination of one or more of them. A propagated signal is an artificially generated signal, e.g. a machine-generated electrical, optical, or electromagnetic signal, that is generated to encode information for transmission to suitable receiver apparatus.

A computer program (also known as a program, software, software application, script, or code) can be written in any programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry such as field-programmable gate array (FPGA) or application-specific integrated circuit (ASIC).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g. magnetic, magneto-optical disks or optical disks. However, a computer need not have such devices. Moreover, a computer can be embedded in another device such as a mobile telephone, a personal digital assistant (PDA), a mobile audio player, a Global Positioning System (GPS) receiver, to name just a few. Computer-readable media suitable for storing computer program instructions and data include all forms of non-volatile memory, media and memory devices, including by way of example semiconductor memory devices (e.g., EPROM, EEPROM, flash memory), magnetic disks, magneto-optical disks, CD-ROM and DVD-ROM disks. The processor and the memory can be supplemented by, or incorporated in, special-purpose logic circuitry.

Embodiments of the invention can be implemented in a computing system that includes a back-end component, e.g. as a data server, or that includes a middleware component, e.g. an application server, or that includes a front-end component, e.g. a client computer having a graphical user interface or a Web browser through which a user can interact with an implementation of the invention, or any combination of one or more such back-end, middleware, or front-end components. The components of the system can be interconnected by any form or medium of digital data communication, e.g., a communication network. Examples of communication networks include a local area network (LAN) and a wide area network (WAN) such as the Internet.

The computing system can include clients and servers. A client and server are generally remote from each other and typically interact through a communication network. The relationship of client and server arises by virtue of computer programs running on the respective computers and having a client-server relationship to each other.

As will be appreciated by one skilled in the art, aspects of the present invention may be embodied as a system, method or computer program product. Accordingly, aspects of the present invention may take the form of an entirely hardware embodiment, an entirely software embodiment or an embodiment combining software and hardware aspects that may all generally be referred to herein as a "circuit," "module" or "system." Furthermore, as described above, aspects of the present invention may take the form of a computer program product embodied in one or more computer readable medium (s) having computer readable program code embodied thereon.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element. It is to be understood that where the claims or specification refer to "a" or "an" element, such reference is not be construed that there is only one of that element.

Methods of the present invention may be implemented by performing or completing manually, automatically, or a combination thereof, selected steps or tasks. The descriptions, examples, methods and materials presented in the claims and the specification are not to be construed as limiting but rather as illustrative only. Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A computer-implemented method comprising:

obtaining data indicative of optical properties of a backlight module and of multi primary filters for a multi primary display including a sub-pixel layout, wherein each sub-pixel is associated with a primary color based on light from each of the multi primary filters;

obtaining a white point chromaticity for the multi primary display, wherein the white point chromaticity is obtained from combination of lights from the multi primary filters;

obtaining, for each one of the primary colors, data indicative of an intensity ratio between the primary color and the white point chromaticity, for the sub-pixel layout;

representing a luminance level of the multi primary display in accordance with the obtained data, at the white point chromaticity, as a set of expressions in terms of relative sizes of the sub-pixels of the multi primary display; and solving the set of expressions to yield ratios of sizes of the sub- pixels of the multi primary display that result in a specified value of luminance at the required white point chromaticity.

2. The method according to claim 1, further comprising solving the expressions to yield ratios of sizes that maximize the specified value of luminance at the required white point chromaticity.

3. The method according to claim 1, wherein the expressions take into account minimal and maximal physical constraints of a size of the sub-pixels.

4. The method according to claim 3, further comprising solving the expressions to yield ratios of sizes that maximize the specified value of luminance at the required white point chromaticity.

5. The methods according to claim 1, further comprising solving the expressions to yield absolute sizes of the sub-pixels that maximize the specified value of luminance at the required white point chromaticity.

6. The method according to claim 1, further comprising solving the expressions to yield a number of the sub-pixels of each primary color that maximizes the specified value of luminance at the required white point chromaticity, wherein the sub-pixels are of equal size, and one or more pixels of each primary are used.

7. The method according to claim 1, wherein the expressions are provided in a form of a cost function being a weighed combination of constraints defined by the set of the expressions.

8. A computer-program product, encoded on a computer-readable medium, operable to cause data processing apparatus to perform operations comprising:

obtaining data indicative of optical properties of a backlight module and of multi primary filters for a multi primary display including a sub-pixel layout, wherein each sub-pixel is associated with a primary color based on light from each of the multi primary filters;

obtaining a white point chromaticity for the multi primary display, wherein the white point chromaticity is obtained from combination of lights from the multi primary filters;

obtaining, for each one of the primary colors, data indicative of an intensity ratio between the primary color and the white point chromaticity, for the multi primary display;

representing a luminance level of the multi primary display in accordance with the obtained data, at the white point chromaticity, as a set of expressions in terms of relative sizes of the sub-pixels of the multi primary display; and solving the set of expressions to yield ratios of sizes of all of the sub-pixels of the multi primary display that result in a specified value of luminance at the white point chromaticity.

* * * * *